US005190429A

United States Patent [19]

Harlegard

[11] Patent Number: 5,190,429

[45] Date of Patent: Mar. 2, 1993

[54] ARRANGEMENT FOR THE OPENING OF RIGID, COLLAPSIBLE CASINGS OR OF FLEXIBLE BAGS

[75] Inventor: Jan Harlegard, Therwil, Switzerland

[73] Assignee: S I C AG, Basel, Switzerland

[21] Appl. No.: 728,614

[22] Filed: Jul. 11, 1991

[30] Foreign Application Priority Data

Jul. 12, 1990 [DE] Fed. Rep. of Germany ..... 4022276

[51] Int. Cl.[5] ..... B65B 69/00; B65F 7/00; A61G 9/00

[52] U.S. Cl. ..... 414/412; 83/165; 83/601; 83/946; 141/330; 222/83.5; 222/105

[58] Field of Search ..... 414/412; 222/88, 83.5, 222/105; 83/165, 601, 604, 946; 141/329, 330

[56] References Cited

U.S. PATENT DOCUMENTS

| | | | |
|---|---|---|---|
| 944,555 | 12/1909 | Holden | 83/601 |
| 2,036,514 | 4/1936 | Wiswell | 141/330 |
| 2,306,426 | 12/1942 | Bundy | 414/412 |
| 2,660,324 | 11/1953 | Trautschold | 414/412 |
| 3,779,120 | 12/1963 | Strawson | 83/601 |
| 4,344,268 | 8/1982 | Wakamatsu et al. | 414/412 X |
| 4,527,716 | 7/1985 | Haas et al. | 414/412 X |
| 4,627,781 | 12/1986 | Borgner | 414/412 |
| 4,746,259 | 5/1988 | Boucherie | 414/412 |
| 4,859,132 | 8/1989 | Chasseray | 414/412 |

FOREIGN PATENT DOCUMENTS

| | | | |
|---|---|---|---|
| 1267615 | 5/1968 | Fed. Rep. of Germany | 414/412 |
| WO83/02722 | 8/1983 | Fed. Rep. of Germany . | |
| 177790 | 10/1966 | U.S.S.R. . | |
| 261971 | 11/1970 | U.S.S.R. | 414/412 |
| 2137157 | 10/1984 | United Kingdom | 414/412 |

*Primary Examiner*—David A. Bucci
*Attorney, Agent, or Firm*—Scully, Scott, Murphy & Presser

[57] ABSTRACT

An arrangement for the opening of rigid, collapsible enclosures or of flexible bags, characterized in that this arrangement consists of a housing having a receiving container arranged therein which is adapted to be opening and closed by an opening lid, in which there are arranged scissors-like knives which are openable and closeable along a rotary axis such that a plurality, parallel-horizontally arranged, fixed knives are in operative connection with parallel, at an angle upwardly and inwardly arranged knives, whereby the movable knives are opened to such an extent and closed through pull rods by use of a motor that, through this movement, the liquid which is contained in the enclosures or bags can flow off into a discharge and thereafter the receiving container arranged on the rotary axle is enabled, by use of a motor, to be rotated so far downwardly until the enclosures can without external contact be expelled from the housing through a rinsing cone and thereafter the receiving container can be turned back for a renewed insertion.

8 Claims, 2 Drawing Sheets

ARRANGEMENT FOR THE OPENING OF RIGID, COLLAPSIBLE CASINGS OR OF FLEXIBLE BAGS

FIELD OF THE INVENTION

In the field of medicine and in the technology there is encountered the necessity of having to remove liquids from encompassing or encasing materials which; in turn, themselves similarly represent a waste constituent. Liquids of that kind are also human secretions, such as urine, or contaminated or spoiled liquids or fluid which are obtained from technological or industrial products or food stuffs. The separation of such liquids which are to be eliminated from their enclosures may not be carried out through the cutting open and squeezing out, in view of the contaminating of the people who are employed therewith, their clothing and of the environment, during this procedure.

BACKGROUND OF THE INVENTION

German Laid-Open Patent Appln. 3 140 467 describes a manually-operated bag-emptying arrangement which possesses, within a housing, a horizontally attached cable on a carrying or supporting arm, on which there is deposited the bag or sack which is to be emptied. For purposes of emptying, a lance is pushed into the sack, and the latter is emptied under a blast of air while being pivoted downwardly. This arrangement is not adapted for the emptying of enclosures containing liquids which are to be eliminated, inasmuch as the pressurized air flow causes fluid or liquid to be sprayed about and the enclosure cannot be removed without being contacted.

The disclosure of German Petty Patent 8 429 069 describes an arrangement for the tearing open of bags for particulate material entrained in liquids, including a flat support surface for the bag with a pivotable lever incorporating a tearing or ripping mandrel at the end thereof, which is moved through the intermediary of a handgrip. This arrangement, which is open on all sides thereof, requiring removal of the emptied bag by hand, is not adapted for the emptying of liquids which are to be eliminated.

German Laid-Open Patent Appln. 36 05 560 discloses an arrangement for the opening and emptying of fluids or liquids from bags or cartons. The cutting open of the filled enclosures is carried out through a horizontal displacement or sliding movement of the cover of the arrangement through a cutting knife which is located below the cover, such that the liquid flows off into an odor trap. The enclosure must be removed by hand subsequent to the sliding back of the cover and then discarded.

In this instance, there is encountered the disadvantage that the personnel which are concerned with the foregoing procedure come again into contact with the enclosures. In actual practice, sprays from the separated liquid of the still adherent residual quantities thereof cannot be avoided. Moreover, during the manipulation of the enclosures or casings by hand which are to be emptied, contaminations of the humans which are concerned therewith and of the environment cannot be avoided.

The foregoing disadvantages are avoided by the arrangement pursuant to the invention, which in contrast with the state-of-the-technology, represents an improvement in the elimination of encapsulated liquids.

SUMMARY OF THE INVENTION

Accordingly, an object of the present invention is the provision of an arrangement for the opening of rigid, compressible or collapsible enclosures or casings, or of flexible bags with therein contained liquids which are to be eliminated, and their emptying from these enclosures, and for the disposal of the enclosures or bags.

Accordingly, an object of the present invention is an arrangement which affords a more secure hygienically satisfactory and rapid disposal of liquids which are contained in enclosures or casings and in bags.

DETAILED DESCRIPTION OF THE INVENTION

The arrangement pursuant to the invention is characterized in that a receiving container for the packings or enclosures is a rotary basket, that the housing can be opened or closed by means of a grip (4*a*) through an opening lid or flap (4) which is movably supported in a hinge structure (4*b*), that below in the housing there are located shears or scissors-like opening and closing knives along a rotary axle (6), in such a manner, that a plurality, preferably two, parallel, horizontally arranged fixed knives (3*a–n*) cooperate with a plurality, preferably two, parallel arranged at an angle upwardly and inwardly extending knives (3*a–n*), that the movable knives (3*a–n*) can be opened and closed through pull rods (7*a–n*), which engage below with levers (13*a–n*) of the knives (3*a–n*) and above with levers (14*a–n*), which are fastened to a rotary axle (8*a–n*) which, in turn, is guided through an external support (8*a*) and a motor bearing (8*b*), and is pivoted or; in essence, rotated by a motor (9), that as a result of this movement, the knives (3*a–n*) penetrate through the enclosures, casings or bags, and the liquid is enabled to flow into the discharge (11), that the rotary basket is arranged on a rotary axle (5) which, in turn, is guided by means of an outer support (5*a*) and through a motor bearing (5*b*), and by means of a motor (10) can be rotated so far downwardly with its opening (12) that the extensively emptied enclosures are swung above the rim of a lip seal 16 equipped edge of a receiving trough (15) which is equipped with the lip seal (16), and without any external contact can slide out of the rotary basket and the housing (1), and that subsequently, the rotary basket (2) can be turned back in a reverse direction of rotation by means of the motor (10) into it initial position for a renewed introduction of filled enclosures or bags.

The arrangement pursuant to the invention is also characterized in that the rotary basket possesses a cylindrical shape and is adapted for utilization in the emptying of enclosures of a compressible or collapsible paper or cardboard which is rendered water-tight through a plastic coating, or for the emptying of flexible plastic bags consisting of transparent, hose-shaped materials.

The arrangement pursuant to the invention is further characterized through the utilization thereof for the emptying of enclosures or bags which contain liquids with slurry-like or finely particulate solids additives or inclusions.

The arrangement of the invention is also characterized in that, in the lower portion of the housing, it incorporates a valve for the inlet of rinsing and cleaning liquids.

The arrangement pursuant to the invention is further characterized in that it includes a control unit and operates in an automatic manner, and that it possesses a separating wall for the separation of the wet chamber from a chamber containing the control unit.

DESCRIPTION OF THE DRAWINGS

The arrangement pursuant to the invention is elucidated in the figures of the drawings, as follows.

Figure 1:
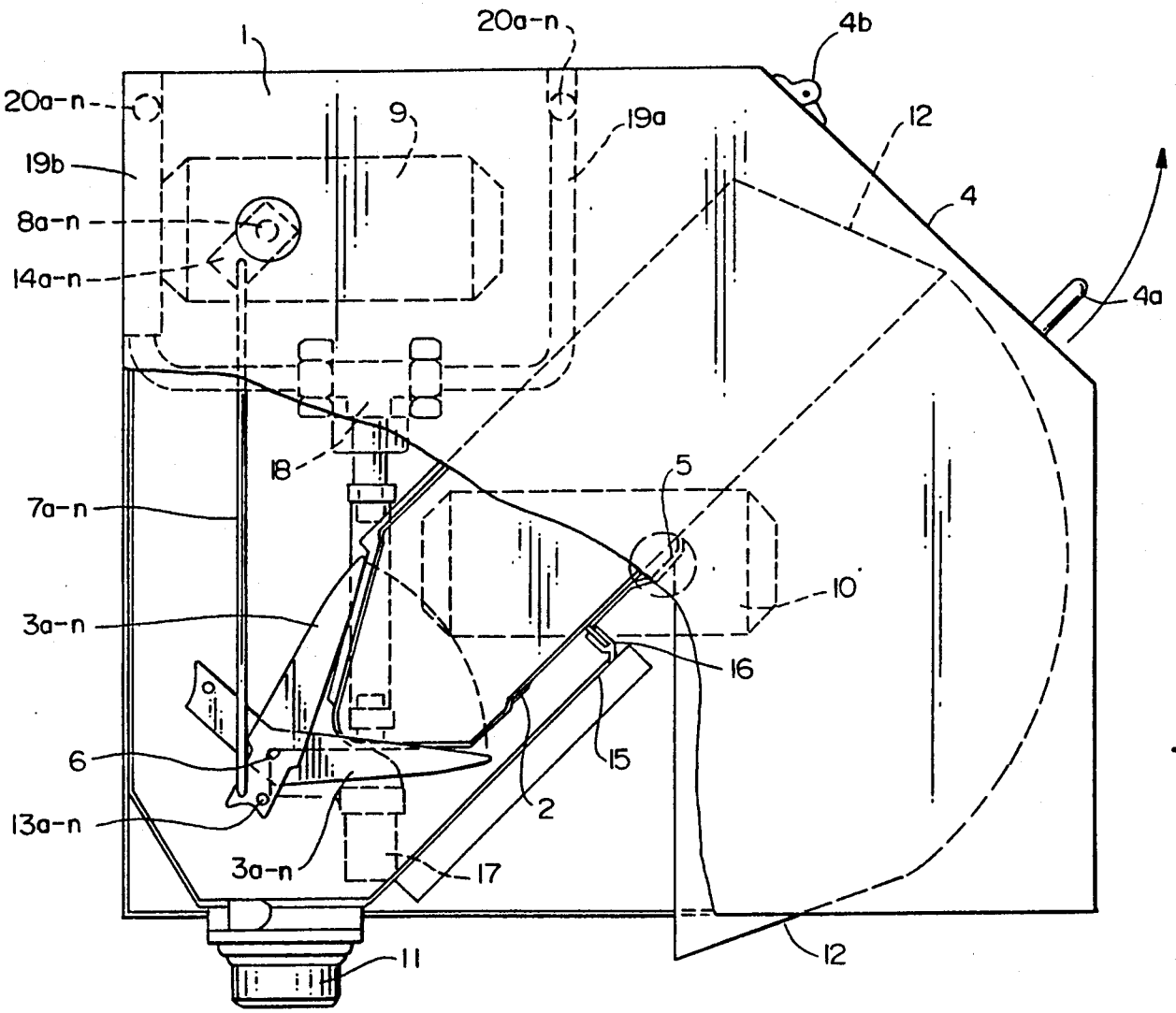
FIG. 1 illustrates a side view thereof.
Figure 2:
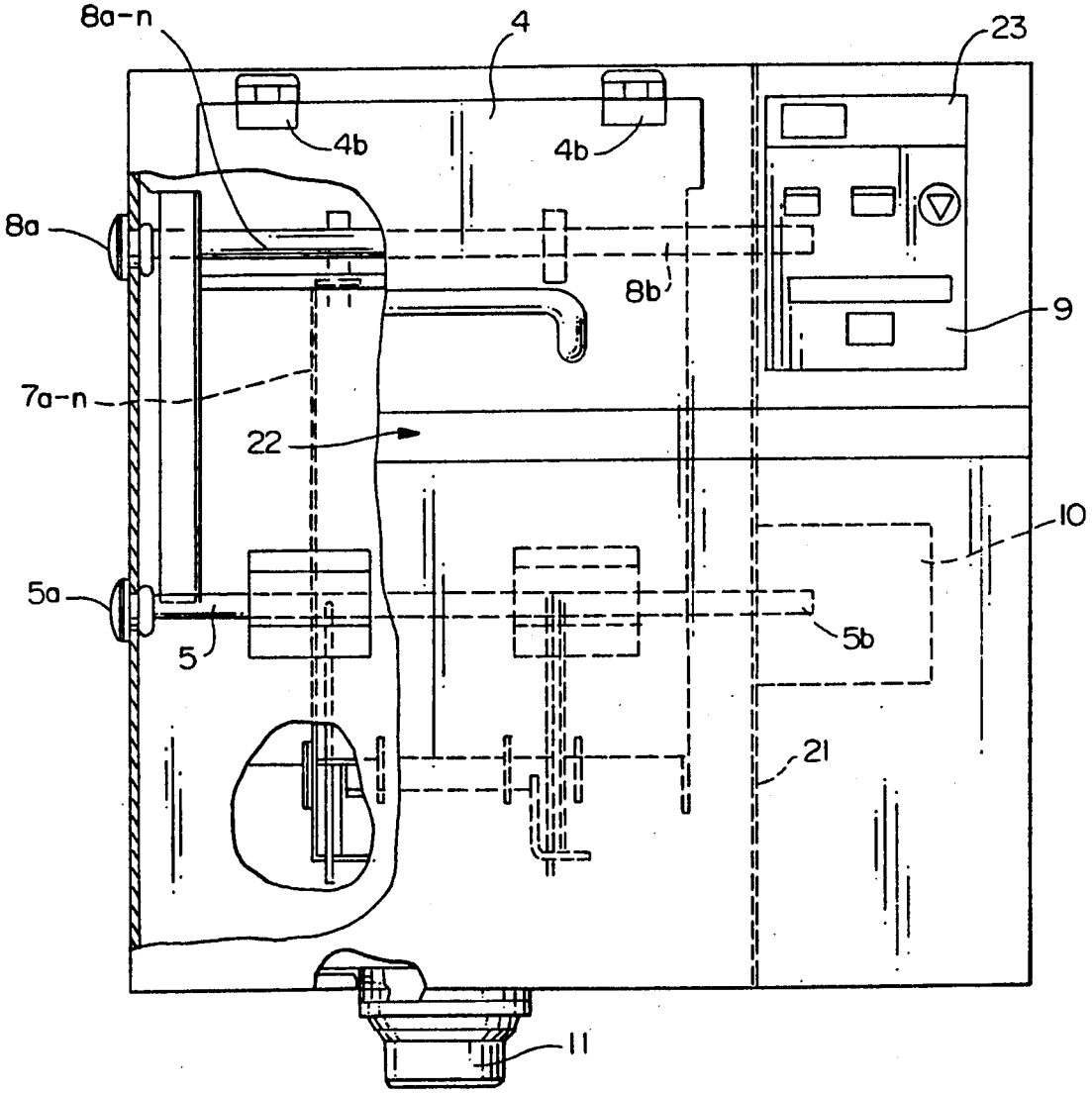
FIG. 2 illustrates a front view.

In the drawing figures the components are identified by the following reference numerals:

Reference numeral 1 is a housing, 2 is a receiving container; 3*a–n* define movable knives; 4 is an opening lid or flap, 4*a* is a grip; 4*b* is a hinge; 5 is a rotary axle for the receiving container 2; 6 is a rotary axle for the knives 3; 7*a–n* are pull rods for the movable knives 3*a–n*; 8*a–n* is a rotary axle for the actuation of the pull rods 7; 9 is a motor for effectuating the movement of the knives; 10 is a motor for effectuating the rotation of the receiving container 2; 11 is the discharge for liquid from the enclosures and bags; 12 is an opening for the expulsion of the enclosures and bags from the receiving container 2; 13*a–n* is the lever for the movable knives; 14*a–n* is the lever for effectuating the movement of the pull rods 7; 15 is a rinsing cone structure; 16 is a lip seal on the rinsing cone structure 15; 17 is a valve for the inlet of rinsing and/or cleaning liquids; 18 is a distributor for conduits leading to 16, 19*a,b* are conduits leading to 16; 20*a–n* are rinsing nozzles; 21 is a separating wall for the separation of the wet chamber 22 from the control installation; 22 is a wet chamber; 23 is a control installation; 5*a* is the outer support for the rotary axle 5; 5*b* is a motor bearing for the rotary axle 5; 8*a* is the outer support for the rotary axle 6; and 8*b* is the motor bearing for the rotary axle 6.

The arrangement pursuant to the invention affords the advantage of a secure disposal of contaminated liquids, as well as for their enclosures or bags.

What is claimed is:

1. An arrangement for the opening, emptying and disposing of liquid containing rigid collapsible enclosures or flexible bags comprising:

(a) a housing (1) having a rotary basket (2) for receiving enclosures or bags, said rotary basket being located in a center of the housing, said housing being accessible through an opening flap (4) which is movably supported by a hinge (46) said flap being openable and closeable by a grip (4*a*);

(b) a plurality of parallel, horizontally fixed knives (3*a–n*) and a plurality of parallel at an angle upwardly and inwardly located movable knives (3*a–n*) disposed in a lower portion of said housing on a first rotary axle (6) such that the movable and the fixed knives cooperate to open and close in a scissors-like manner;

(c) a plurality of pull rods (7*a–n*) which are engaged below with levers (13*a–n*) of the parallel at an angle upwardly and inwardly located movable knives and above with levers (14*a–n*) which are fastened to a second rotary axle (8*a–n*) which is guided by a first outer support (8*a*) and a first motor bearing (8*b*), said second rotary axle being pivoted by a first motor (9) such that through this movement, the movable knives and the fixed knives open and close in a scissors-like manner which causes the movable knives to penetrate through parallel slits in the rotary basket and cut the collapsible enclosure or the flexible bag located inside the rotary basket which in turn allows a liquid contained in the collapsible enclosure or the flexible bag to flow off into a discharge (11);

(d) a second motor (10) having a third rotary axle (5) guided by a second outer support (5*a*) and a second motor bearing (5*b*), said rotary basket being attached to the third rotary axle and through the second motor rotated forwardly to such an extent that an opening (12) in the rotary basket is pivoted over a receiving through (15) having a lip seal (16) such that the substantially empty enclosure or bag located within the rotary basket, without any external contact, can slide out of the rotary basket and the housing and thereafter said rotary basket can be rotated in a reverse direction by the second motor into its initial position for a renewed insertion of a liquid-filled enclosure or bag.

2. An arrangement as claimed in claim 1, characterized in that the rotary basket (2) has a cylindrical shape.

3. An arrangement as claimed in claims 1 or 2, characterized through the utilization thereof for the emptying of enclosures of a collapsible paper or cardboard waterproofed by plastic coatings or for the emptying of flexible plastic bags consisting of transparent, hose-shaped materials.

4. An arrangement as claimed in claim 3, characterized through the utilization thereof for the emptying of enclosures or bags which contain liquids with slurry like or fine-particulate solid additives entrained therein.

5. An arrangement as claimed in claim 4, characterized that it includes a valve (17) in the lower part of the housing (1) for the inlet of rinsing and cleaning fluids.

6. An arrangement as claimed in claim 5, characterized in that it includes a control unit and operates automatically.

7. An arrangement as claimed in claim 6, characterized in that it includes a separating wall (21) for the separating of a wet chamber from a chamber containing the control unit.

8. An arrangement as claimed in claim 1 wherein the number of parallel, horizontally arranged fixed knives and the number of parallel at an angle upwardly and inwardly located movable knives is 2.

* * * * *